US010881891B2

(12) United States Patent
Brancato et al.

(10) Patent No.: US 10,881,891 B2
(45) **Date of Patent: *Jan. 5, 2021**

(54) FITNESS TRAINING APPARATUS

(71) Applicants: Giacomo Brancato, Roslyn Heights, NY (US); Paul Brancato, New Hyde Park, NY (US)

(72) Inventors: Giacomo Brancato, Roslyn Heights, NY (US); Paul Brancato, New Hyde Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/243,258

(22) Filed: Jan. 9, 2019

(65) Prior Publication Data

US 2019/0143165 A1 May 16, 2019

Related U.S. Application Data

(63) Continuation of application No. 15/293,623, filed on Oct. 14, 2016, now Pat. No. 10,207,139.
(Continued)

(51) Int. Cl.
*A63B 21/04* (2006.01)
*A63B 21/045* (2006.01)
(Continued)

(52) U.S. Cl.
CPC ..... *A63B 21/0442* (2013.01); *A63B 21/045* (2013.01); *A63B 21/0557* (2013.01);
(Continued)

(58) Field of Classification Search
CPC ..... A63B 21/0442; A63B 23/03508; A63B 21/4027; A63B 23/03541; A63B 23/0205;
(Continued)

(56) References Cited

U.S. PATENT DOCUMENTS 866,495 A * 9/1907 Marks ..... A63B 21/02 482/124
1,194,884 A * 8/1916 Sandow ..... A63B 21/0004 482/124
(Continued)

FOREIGN PATENT DOCUMENTS

GB 2475546 A 5/2011

OTHER PUBLICATIONS

International Search Report dated Jan. 17, 2017 for PCT Application No. PCT/US2016/057015, filed Oct. 14, 2016, 3 pages.
(Continued)

*Primary Examiner* — Andrew S Lo
(74) *Attorney, Agent, or Firm* — Kelley Drye & Warren LLP

(57) ABSTRACT

A fitness training apparatus is described that can include at least one pole, at least one set of one or more adjustable members, and at least one elastic member. The at least one pole can be configured to extend from at least one vicinity of at least one shoulder of a user to another at least one vicinity of a waist of the user. The at least one set of one or more adjustable members can be adjustably coupled to the at least one pole. The at least one elastic member can be configured to be adjustably coupled to the at least one set of one or more adjustable members. Related methods, techniques, articles, systems, and apparatuses are also described.

20 Claims, 10 Drawing Sheets

Related U.S. Application Data

(60) Provisional application No. 62/242,451, filed on Oct. 16, 2015.

(51) Int. Cl.

| | |
|---|---|
| ***A63B 21/00*** | (2006.01) |
| ***A63B 23/02*** | (2006.01) |
| ***A63B 23/035*** | (2006.01) |
| ***A63B 21/055*** | (2006.01) |
| ***A63B 23/12*** | (2006.01) |

(52) U.S. Cl.
CPC ..... *A63B 21/4005* (2015.10); *A63B 21/4007* (2015.10); *A63B 21/4009* (2015.10); *A63B 21/4011* (2015.10); *A63B 21/4025* (2015.10); *A63B 21/4027* (2015.10); *A63B 21/4035* (2015.10); *A63B 23/0205* (2013.01); *A63B 23/03508* (2013.01); *A63B 23/03541* (2013.01); *A63B 23/1209* (2013.01); *A63B 2225/09* (2013.01)

(58) Field of Classification Search
CPC ..... A63B 21/4035; A63B 21/045; A63B 21/0552; A63B 21/0557; A63B 21/4043; A63B 21/00069; A63B 21/00065; A63B 23/1209
USPC ..... 482/121–130
See application file for complete search history.

(56) References Cited

U.S. PATENT DOCUMENTS 1,780,308 A * 11/1930 Morris ..... B05B 15/625 248/86
4,779,867 A * 10/1988 Hinds ..... A63B 21/0552 482/122
4,911,439 A 3/1990 Kuhl
5,024,443 A * 6/1991 Bellagamba ..... A63B 21/0552 473/212
5,190,512 A * 3/1993 Curran ..... A63B 21/0004 482/122
D358,625 S * 5/1995 Enriquez, Jr. ..... A63B 21/0004 D21/686
5,462,518 A * 10/1995 Hatley ..... A61F 5/024 482/124
5,490,825 A 2/1996 Wilkinson
5,752,900 A * 5/1998 Holland, Jr. ..... A63B 21/0004 482/124
5,769,764 A * 6/1998 Tilberis ..... A63B 23/03575 482/124
5,792,034 A * 8/1998 Kozlovsky ..... A63B 21/0004 482/124
5,803,881 A * 9/1998 Miller ..... A63B 21/0004 482/124
6,267,711 B1 * 7/2001 Hinds ..... A63B 1/00 482/121
6,280,365 B1 * 8/2001 Weber ..... A63B 21/018 482/124
6,287,242 B1 * 9/2001 Fray ..... A63B 21/0004 482/121
6,659,921 B2 12/2003 Vernon
7,147,590 B2 * 12/2006 Toven ..... A63B 69/0028 482/51
7,699,762 B2 * 4/2010 Turnbull ..... A63B 21/04 482/130
7,744,512 B2 * 6/2010 Clarke ..... A63B 23/1209 482/124
8,088,053 B2 * 1/2012 Whyatt ..... A63B 21/018 482/143
8,403,818 B1 * 3/2013 Wilkinson ..... A63B 21/00069 482/121
8,801,583 B1 * 8/2014 Shenkin ..... A63B 21/0555 482/124
8,905,904 B2 * 12/2014 Carter ..... A63B 21/153 482/129
9,072,935 B2 7/2015 Ross
9,833,677 B2 * 12/2017 Ross ..... A63B 60/16
10,207,139 B2 2/2019 Brancato et al.
2004/0185990 A1 * 9/2004 Orescan ..... A63B 21/0552 482/126
2005/0037904 A1 * 2/2005 Chang ..... A63B 21/00043 482/122
2005/0130814 A1 * 6/2005 Nitta ..... A63B 1/00 482/121
2009/0062087 A1 3/2009 Poppinga
2009/0215594 A1 * 8/2009 Panaiotov ..... A63B 21/0552 482/130
2009/0258768 A1 * 10/2009 Clarke ..... A63B 21/0004 482/124
2010/0048368 A1 * 2/2010 Donofrio ..... A63B 1/00 482/130
2011/0111890 A1 * 5/2011 Webb ..... A63B 69/0002 473/458
2011/0195822 A1 * 8/2011 Donofrio ..... A63B 1/00 482/93
2012/0322635 A1 * 12/2012 Carter ..... A63B 21/4043 482/129
2014/0018215 A1 * 1/2014 Donofrio ..... A63B 1/00 482/129
2014/0031181 A1 * 1/2014 Agostini ..... A63B 21/0442 482/129
2014/0106948 A1 * 4/2014 Agostini ..... A63B 21/0442 482/129
2014/0315699 A1 * 10/2014 Winbush ..... A63B 69/0028 482/139
2014/0357460 A1 * 12/2014 Sorace ..... A63B 23/1236 482/141
2015/0182775 A1 * 7/2015 Toback ..... A63B 5/16 482/130
2015/0374290 A1 * 12/2015 Spears ..... A61B 5/1112 600/595
2016/0008655 A1 * 1/2016 Martin ..... A63B 21/4043 482/124
2016/0332708 A1 * 11/2016 White ..... A63B 69/0093

OTHER PUBLICATIONS

Written Opinion dated Jan. 17, 2017 for PCT Application No. PCT/US2016/057015, filed Oct. 14, 2016, 9 pages.

* cited by examiner

FITNESS TRAINING APPARATUS

RELATED APPLICATION

This patent application is a continuation of and claims priority to U.S. patent application Ser. No. 15/293,623, entitled "Fitness Training Apparatus" and filed on Oct. 14, 2016, which claims priority to U.S. Provisional Patent Application Ser. No. 62/242,451, entitled "Fitness Training Apparatus and Method of Use", and filed on Oct. 16, 2015, the contents of both applications are incorporated herein by reference in their entirety.

TECHNICAL FIELD

The subject matter described herein generally relates to a light-weight fitness training apparatus that a user can wear on his body to perform exercises for strength, endurance and cardiovascular training. More specifically, the fitness training apparatus can include an elastic strap, the length of which is adjustable, that the user can pull while using his or her body as an anchor, thereby enabling the user to perform exercises while preventing any bulkiness in the fitness training apparatus.

BACKGROUND

Weightlifting and strength training require an often bulky series of bands and/or weights which require space and attachment to other objects to be effective. This makes it almost impossible to effectively have a portable system that allows effective fitness training (adjustable to the fitness level of the person) in any place and at any time. There is also no way to combine resistance or weight training while in a walking or running motion. Moreover, none of the current resistance training products offer the ability to use the body exclusively as the anchor for the resistance bands or that allow for adjusting the anchor location of the resistance bands on the user's body, as desired by the user.

SUMMARY

In one aspect, a fitness training apparatus is described that can include: at least one pole, at least one set of one or more adjustable members, and at least one elastic member. The at least one pole can be configured to extend from at least one vicinity of at least one shoulder of a user to another at least one vicinity of a waist of the user. The at least one set of one or more adjustable members can be adjustably coupled to the at least one pole. The at least one elastic member can be configured to be adjustably coupled to the at least one set of one or more adjustable members.

In some variations, one or more of the following can be implemented either individually or in any feasible combination. The fitness training apparatus can further include at least one handle attached to the at least one elastic member. The adjustable coupling between the at least one set of one or more adjustable members and the at least one pole can enable a variation in location of the at least one set of one or more adjustable members along the at least one pole. The adjustable coupling between the at least one elastic member and the at least one set of one or more adjustable members can enable a variation in location of the at least one set of one or more adjustable members along the at least one elastic member enabling a variability of a length of the at least one elastic member. The at least one pole can be configured to be attached to at least one harness strap at the at least one vicinity of the at least one shoulder of the user. The at least one harness strap can be configured to extend along a torso of the user. The at least one harness strap can be secured in place via a fastening mechanism configured to be located along a back of the user. The at least one harness strap can be embedded within a clothing garment.

The at least one pole can be configured to be attached to a belt at the at least one vicinity of the waist of the user. The belt can be configured to be attached to at least one leg strap. The at least one leg strap can be configured to wrap around at least one respective leg of the user. The at least one pole can have a shape of a bow. The at least one set of one or more adjustable members can include at least one bracket and at least one lever. The at least one bracket can be capable of moving along a length of at least one of: the at least one pole and the at least one elastic member when the at least one lever is in an open position. The at least one bracket can be prevented from moving along a length of at least one of: the at least one pole and the at least one elastic member when the at least one lever is in a closed position.

The at least one set of one or more adjustable members can include at least one first bracket, at least one first thumb screw configured to pass through the at least one first bracket, at least one second bracket, and at least one second thumb screw configured to pass through the at least one second bracket. A tightening of the at least one first thumb screw can hinder a movement of the at least one first bracket along a length of the at least one pole. A loosening of the at least one first thumb screw can allow a movement of the at least one first bracket along the length of the at least one pole. A tightening of the at least one second thumb screw can hinder a movement of the at least one second bracket along a length of the at least one elastic member. A loosening of the at least one second thumb screw can allow a movement of the at least one second bracket along the length of the at least one elastic member.

The at least one set of one or more adjustable members can include at least one connector, at least two washers, and at least one thumb screw configured to pass through the at least two washers and the at least one connector. A tightening of the at least one thumb screw can hinder a movement of the at least one connector along a length of the at least one pole. A loosening of the at least one thumb screw can allow a movement of the at least one connector along the length of the at least one pole. A tightening of the at least one thumb screw can hinder a movement of the at least one connector along a length of the at least one elastic member. A loosening of the at least one thumb screw can allow a movement of the at least one connector along the length of the at least one elastic member.

The at least one pole can be two poles. The at least one set of one or more adjustable members can be two sets of one or more adjustable members. The at least one elastic member can be two elastic members. The at least one handle can be two handles.

In another aspect, a method of using a fitness training apparatus is described. A bracket can be moved along a length of a pole to a particular location on the pole. An elastic member can be moved to have a particular portion of the elastic member included within the bracket. A lever operably coupled to the bracket can be rotated to a closed position to lock the bracket at the particular location on the pole and to fix a portion of the length of the elastic member that can be strained when the elastic member is stretched. A portion of the elastic member that extends beyond the particular portion of the elastic member included within the bracket can be stretched.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

Like reference symbols in the various drawings indicate like elements.

DETAILED DESCRIPTION

Figure 1:
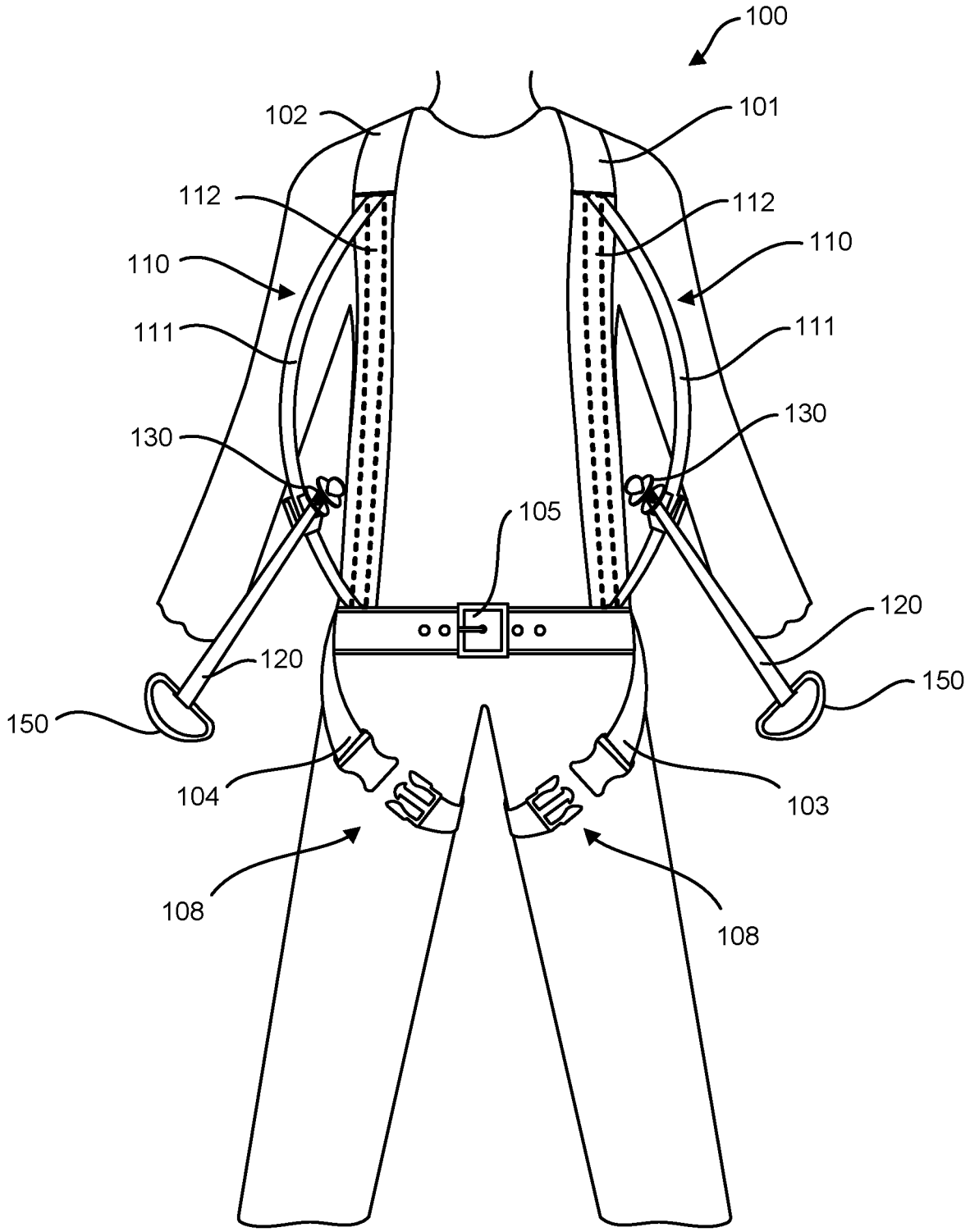
FIG. 1 illustrates a front view of the fitness training apparatus, in accordance with some implementations of the current subject matter.
Figure 2:
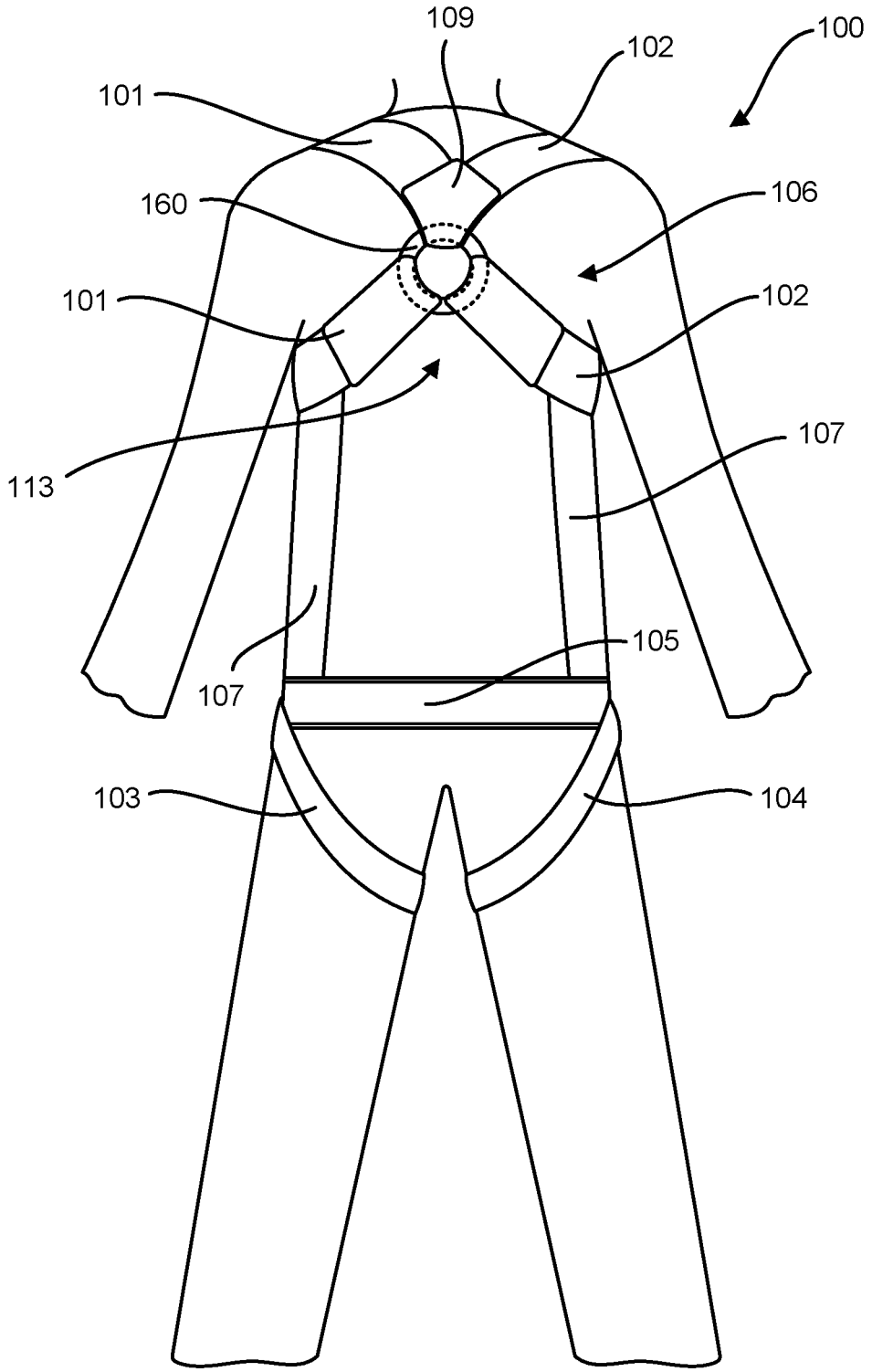
FIG. 2 illustrates a rear view of the fitness training apparatus, in accordance with some implementations of the current subject matter.

FIGS. 1 and 2 illustrate an exemplary fitness training apparatus 100, in accordance with some implementations of the current subject matter. The human body shown in the drawings here is merely to depict how the fitness training apparatus 100 can be used by a user and in no way limits the scope of the invention. The fitness training apparatus 100 can include two main harness straps 101 and 102 that can run from the user's shoulders to the waist area. At the waist area, the straps 101 and 102 can be connected to a belt 105 and leg straps 103 and 104. The leg straps 103 and 104 can wrap around each respective leg of the user. Each of the leg straps 103 and 104 can include a buckle 108 to allow the user to quickly dismount from that leg strap. The buckles can be snap-fit buckles, as shown in FIG. 1. In alternate implementations, any other buckles can be used, such as one or more clasps, one or more buckle trims (which can also be referred to as slides), one or more belt buckles, one or more side release buckles, and/or any combination thereof.

Each harness strap (101 and 102) can include a rigid member 110 that can include an attachment member 112 and a rigid pole 111. The attachment member 112 and the pole 111 are described in further detail below with respect to FIG. 3. As shown in FIG. 1, each rigid member 110 can extend in parallel to each other along the torso of the user—that is, from the waist area of the user to the collar bone area of the user. The rigid members 110 can be sewn to respective harness straps (101 and 102), via attachment members 112, and can be constructed and arranged to provide a rigid support for elastic members 120 that are connected to the rigid members 110 via adjustable connectors 130. The connectors 130 can be adjustably coupled to rigid members 110, via poles 111, so that the base or proximal end of elastic members 120 can be adjusted along at least a portion of rigid members 110. The connectors 130 can slide along the length of poles 111 of rigid members 110, and can lock onto poles 111 at any location along their length, as desired by the user, via a locking mechanism, which is described in further detail below with respect to FIG. 4.

In some variations, poles 111 of rigid members 110 can include demarcations or markings, such as color coding (not shown in the figures), to instruct the user where to lock connectors 130 on poles 111 of rigid members 110 in order to perform specific, desired exercises. In some embodiments, a handle 150 may be provided at a distal end of each elastic member 120. The handle 150 can, in implementations alternate to the one shown in FIG. 1, be one of: a 'D' shaped handle, a 'T' shaped handle, a bar handle, a bow handle, a cup handle, a drop handle, a fingers insertion only handle, an inset handle, a knob, a lay on handle, a profile handle, and any other handles. In operation and in preparation to perform a desired exercise, the user can lock connectors 130 at a desired location along the length of pole(s) 111 of rigid member(s) 110. Once connectors 130 are locked onto poles 111, the user can begin the desired exercise. The user can, for example, hold handles 150 and push or pull on elastic members 120 to perform various exercises such as a shoulder press (as discussed below with respect to FIG. 5), chest press (as discussed below with respect to FIG. 6), bicep curls, and the like. The adjustability of connectors 130 along the length of poles 111 of rigid members 110 allows the user to push/pull at different desired angles.

The fitness training apparatus 100 can generate resistance by using the user's body as an anchor, thereby enabling the user to perform exercises while preventing any bulkiness in the fitness training apparatus. The fitness training apparatus 100 can accordingly be lightweight, and thus portable. Because the fitness training apparatus 100 prevents the need to anchor to objects other than the user's body, the fitness training apparatus 100 requires minimal space. Therefore, the fitness training apparatus 100 can enable the user to perform exercises anywhere, including in tight places, and even while walking or jogging. The fitness training apparatus 100 can allow a user to perform different exercises in a variety of positions, thereby enabling a complete workout of the entire body.

In one variation, the fitness training apparatus 100 can be embedded within one or more clothing garments, such as a vest, a tee shirt, a shirt, a sweatshirt, a sweater, a pair of shorts, a pant, a belt, and/or the like. This embedding can be performed by an attachment mechanism, such as stitches, glue, any other attachment mechanism, and/or any combination thereof.

In some implementations, a posture belt can be coupled with the fitness training apparatus 100 to provide an additional or alternate means for anchoring fitness training apparatus 100 to the body of the user, provide support or guidance to the user while performing various exercises, and provide support for improving the user's posture.

FIG. 2 illustrates a rear view of the fitness training apparatus 100 of FIG. 1. As shown, harness straps 101 and 102 can wrap over the shoulders and under the arms of the user, and can be joined together at the ring 160 to form a support 106. The top portion 109 of the support 106 can be formed by: joining the top portions of the straps 101 and 102, wrapping the joined portion around ring 160, and sewing the joined portion onto itself, as shown in FIG. 2. The lower portion 113 of the support 106 can be formed by: individually wrapping the lower portions of straps 101 and 102 around the ring 160, and attaching each respective lower portion of straps 101 and 102 onto itself via a fastening mechanism, an example of which can be a hook and loop fastener (not shown) such as a VELCRO fastener. This construction can allow the user to adjust apparatus 100 so as to fit firmly and properly on the user's body. The harness straps 101 and 102 can optionally, for additional support, have additional portions 107 that can extend from under the arms of the user and can be secured to belt 105.

Figure 3:
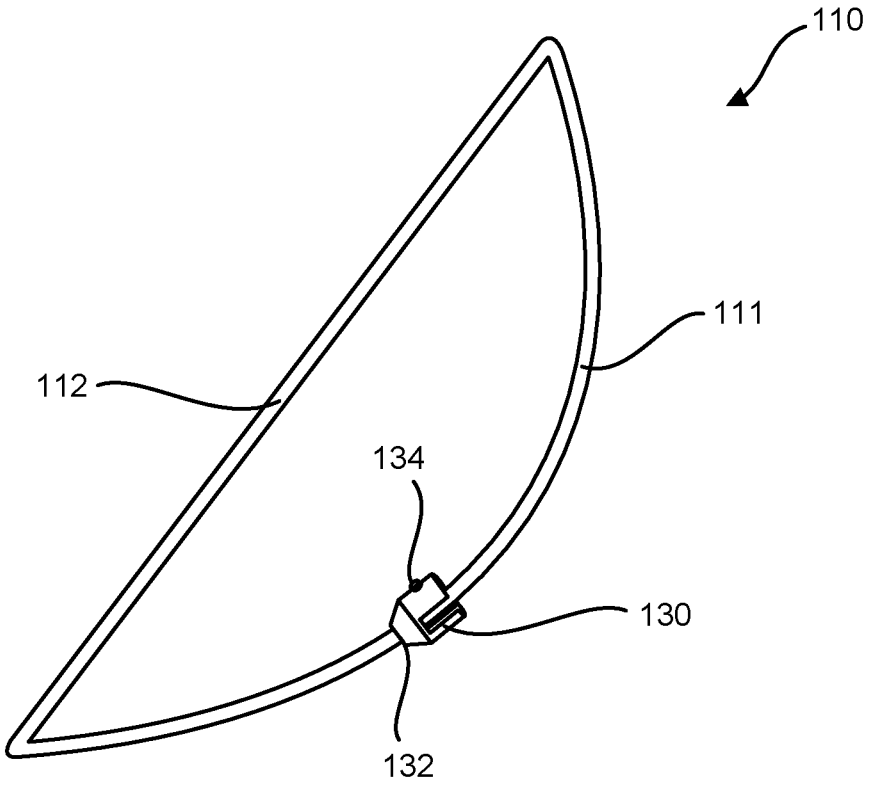
FIG. 3 illustrates an exemplary rigid member within the fitness training apparatus, in accordance with some implementations of the current subject matter.

FIG. 3 illustrates one example of rigid members 110 that may be used in some implementations. Here, the rigid member 110 can include a rigid pole 111 and an attachment member 112. The rigid pole 111 can be attached to the attachment member 112, which can further be attached (for example, sewn) to the harness straps 101 and 102. The attachment member 112 can be a straight rod, and the rigid pole 111 can have a shape of a bow. While particular shapes have been described for the attachment member 112 and the rigid pole 111, any of the attachment member 112 and the rigid pole 111 may have any other shape. Both the attachment member 112 and the rigid pole 111 can be constructed using a rigid, lightweight metal. The pole 111 can be attached to the attachment member 112 to form the rigid member 110 as a unitary component via an attachment mechanism, such as welding or any other attachment mechanism.

As shown in FIG. 3, the rigid pole 111 can allow connector 130 to slide thereon and to lock onto rigid pole 111 at any desired location along its length, via a locking mechanism or adjustment members, as described in detail below with respect to FIG. 4. The connector 130 can be cylindrical in shape, and can include a first opening 132 traversing its length to allow for pole 111 to slide through that first opening 132. The connector 130 can also include a second opening 134 provided in its side, which can be threaded and used to receive a thumb screw 121 (as described below with respect to FIG. 4) for locking the connector 130 to the pole 111 at a particular position. Various types of rigid members 110 can be implemented. For example, the rigid members 110 can, in one implementation, include attachment members 112 without poles 111, whereby connectors 130 can slide up and down and lock-on to attachment members 112 as similarly described above with respect to poles 111.

Figure 4:
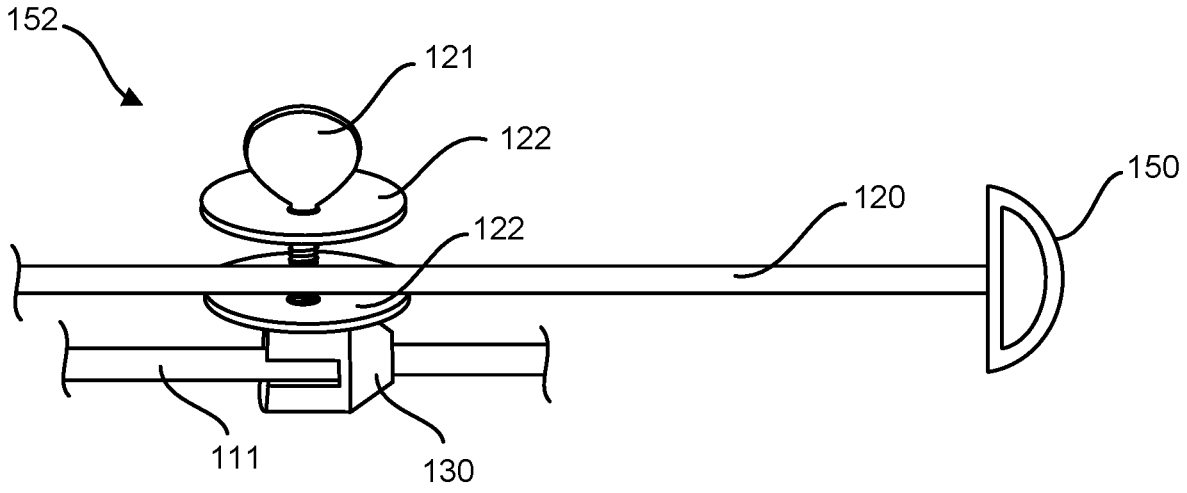
FIG. 4 illustrates an enlarged view of exemplary adjustment members implemented in the fitness training apparatus, in accordance with some implementations of the current subject matter.

Moreover, in some implementations such as the one shown in FIG. 4, a locking mechanism or adjustment members 152 may be provided to adjustably couple elastic members 120 to rigid members 110 and to allow adjustment of the length of elastic members 120. Here, the locking mechanism or adjustment members 152 include a thumb screw 121 that can screw into connector 130, via the opening 134 (described by FIG. 3) provided in its side, and a pair of washers 122. In operation, the user can (i) loosen the connection between connector 130 and pole 111 using thumb screw 121, (ii) slide connector 130 to the desired location along pole 111, (iii) move elastic member 120 into the desired position between washers 122, and (iv) tighten thumb screw 121 into the opening 134 (described by FIG. 3) provided on the side of connector 130, thereby pushing washers 122 closer together to fixedly hold elastic member 120 in place. In this example, thumb screw 121 also locks connector 130 in place on rigid pole 111. In other words, thumb screw 121 enables both the position adjustment of connector 130 on rigid pole 111, and the length adjustment and stabilization of elastic member 120. This can allow the user to adjust the desired resistance provided by elastic members 120 and/or the desired range of motion or exercises. Each washer 122 can include gripping elements or teeth on the interior surface to provide additional grip for securely holding elastic member 120 in place therebetween. The elastic members 120 can be easily replaceable and interchangeable to allow the user to easily replace one resistance band with another. In some implementations, elastic members 120 can be rubber fitness bands or tubes.

Figure 5:
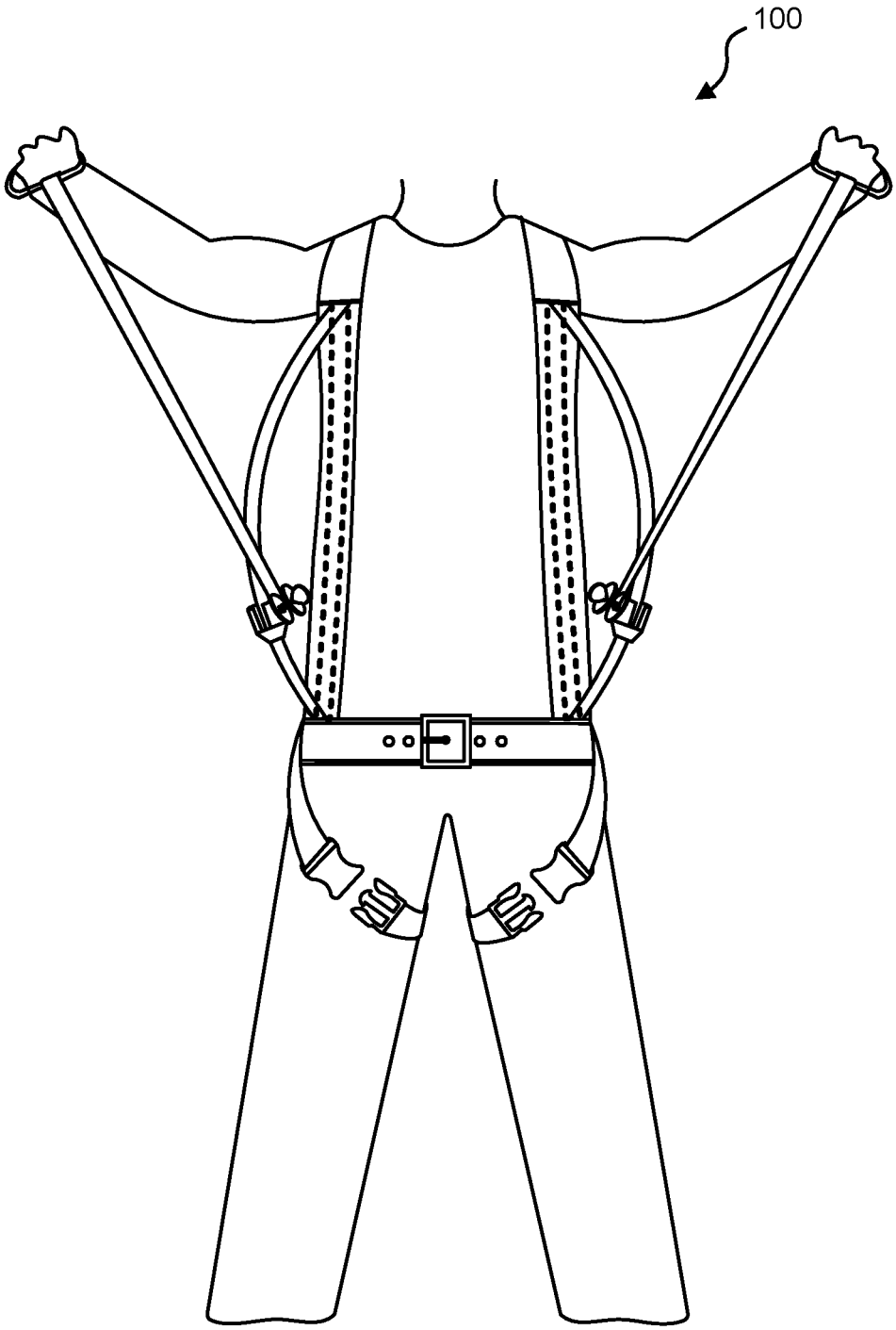
FIG. 5 illustrates a front view of the fitness training apparatus when being used by a user for an exercise, in accordance with some implementations of the current subject matter.
Figure 6:
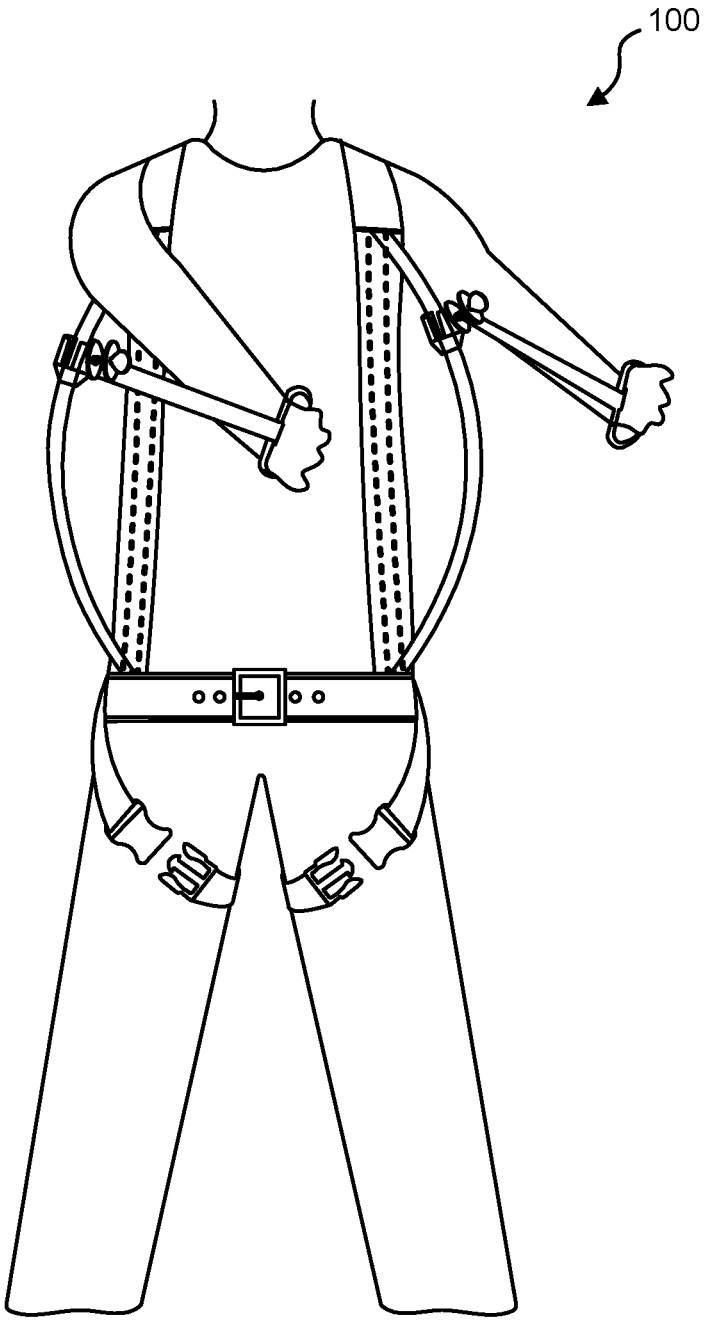
FIG. 6 is a front view of the fitness training apparatus when being used by a user for another exercise, in accordance with some implementations of the current subject matter.

As can be seen from FIGS. 5 and 6, the fitness training apparatus 100 can provide a wide range of adjustments to enable the user to perform a full range of exercises. As shown in the example in FIG. 5, the user can set connectors 130 at the lower end of rigid members 110 to perform exercises such as a shoulder press, bicep curls and/or any other type of exercise. The connectors 130 can also be set at the higher end of rigid members 110 as shown in FIG. 6 to perform various exercises, such as a shoulder press, chest press, and/or any other type of exercise. As can be appreciated by one skilled in the art, other exercises and ranges of motions are possible. The rigid members 110 can be attached to straps 101 and 102 so as to be able to pivot about the vertical axis of straps 101 and 102, thereby making additional exercises and ranges of motions available to the user.

Figure 7:
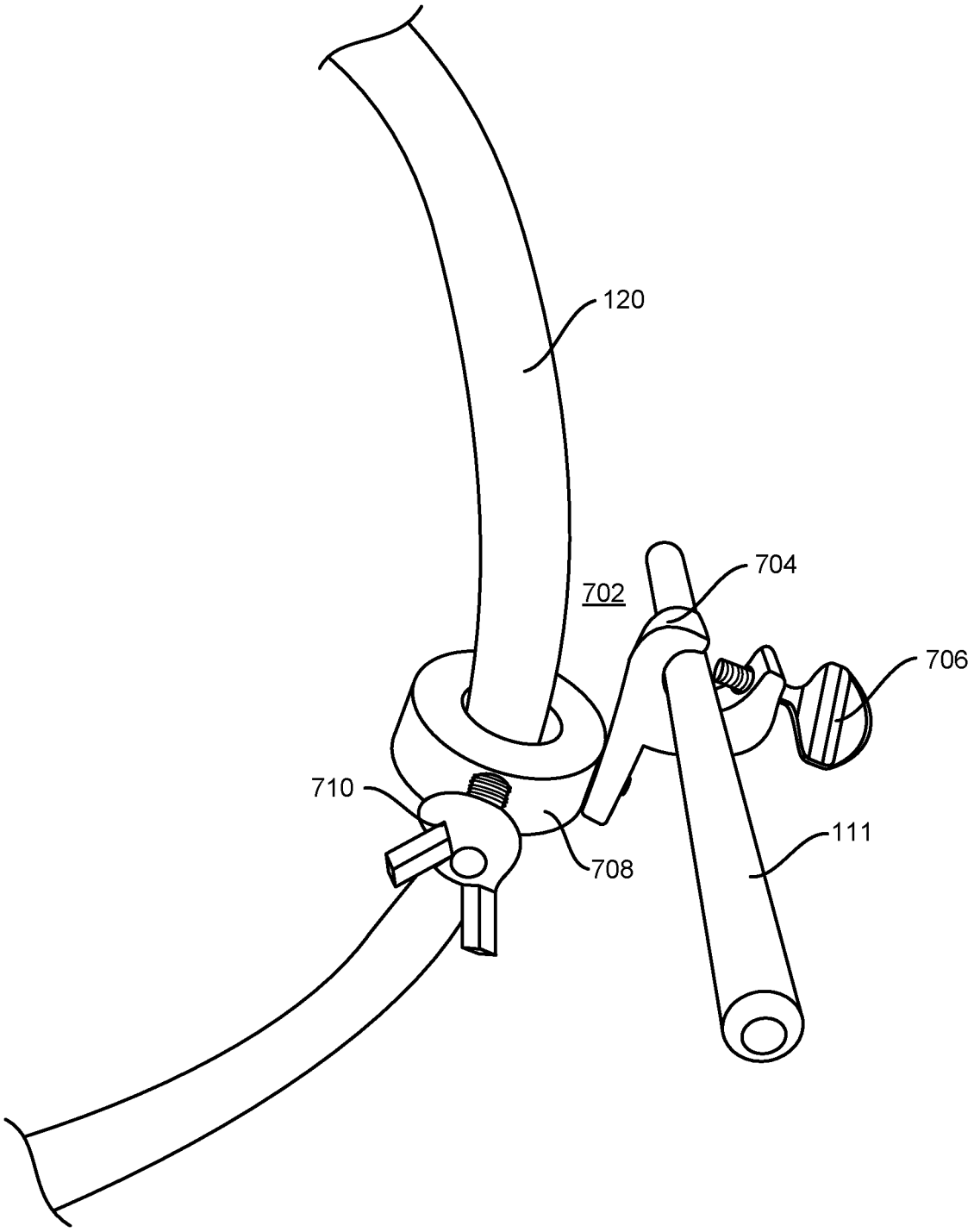
FIG. 7 illustrates alternate adjustment members that can be used instead of the adjustment members described by FIG. 4.

FIG. 7 illustrates alternate adjustment members 702 that implement an alternate locking mechanism that can be used instead of the locking mechanism 152 illustrated in FIG. 4. The adjustment members 702 can include a first bracket 704, a first thumb screw 706 configured to pass through a portion of the first bracket 704, a second bracket 708 attached to the first bracket 706, and a second thumb screw 710 configured to pass through a portion of the second bracket 708.

The first bracket 704 and the first thumb screw 706 can function to enable adjustability of a position of the first bracket 704 at a desirable location (for example, a desirable point) along the length of the pole 111. More specifically, a user can tighten the first thumb screw 706 when the first bracket 704 is at a desirable location along the length of the pole 111. The second bracket 708 and the second thumb screw 710 can function to enable adjustability of a position of the second bracket 708 along a desirable location (for example, a desirable point) along the length of the elastic member 120. More particularly, a user can tighten the second thumb screw 710 when the second bracket 708 is at a desirable location along the length of the elastic member 120. The desirable location can be a portion—of the entire length of the elastic member 120—that bears resistance when a user pushes or pulls the handle 150. That is, the user can adjust the position of the second bracket 708 along the length of the elastic member 120 to adjust the resistance provided by the elastic member 120.

The first bracket 704 can be an "h" shaped bracket, as shown. In alternate implementations, the first bracket 704 can have other shapes, such as "u", "n", "U", "c", "o", "p", "P", "L", or any other suitable shape that enables the functionality of an "h" shaped structure of the first bracket 704. The second bracket 708 can have a circular shape, such as an "O" shape, as shown. In some variations, the second bracket 708 can have other shapes, such as "h", "u", "n", "U", "c", "p", "P", "L", or any other suitable shape that enables the functionality of an "o" shaped structure of the second bracket 708.

The first bracket 704 can be attached to the second bracket via an attachment mechanism, such as welding. The welding can be a metal welding mechanism, a glass welding mechanism, a plastic welding mechanism, any combination thereof, and/or the like. Although welding is described as an attachment mechanism, in other implementations any other attachment mechanism may be used, such as gluing, attaching via a structural lock, stitching, or a screw, or any other attachment mechanism, and/or any combination thereof.

Different parts of the first bracket 704 can be made of a single/same material or of different materials. The one or more materials that can be used for the first bracket 704 can include metal, thermoplastic, thermoset, any other material, and/or any combination thereof. Different parts of the first thumb screw 706 can be made of a single/same material or of different materials. The one or more materials that can be used for the first thumb screw 706 can include metal, thermoplastic, thermoset, any other material, and/or any combination thereof.

Different parts of the second bracket 708 can be made of a single/same material or of different materials. The one or more materials that can be used for the second bracket 708 can include metal, thermoplastic, thermoset, any other material, and/or any combination thereof. Different parts of the second thumb screw 710 can be made of a single/same material or of different materials. The one or more materials that can be used for the second thumb screw 710 can include metal, thermoplastic, thermoset, any other material, and/or any combination thereof.

In some implementations, brackets described herein can be any object used for support. In those implementations, a bracket can also be referred to as a brace, a frame, a clip, a support device, a mechanical device, a mount, and/or the like.

Figure 8:
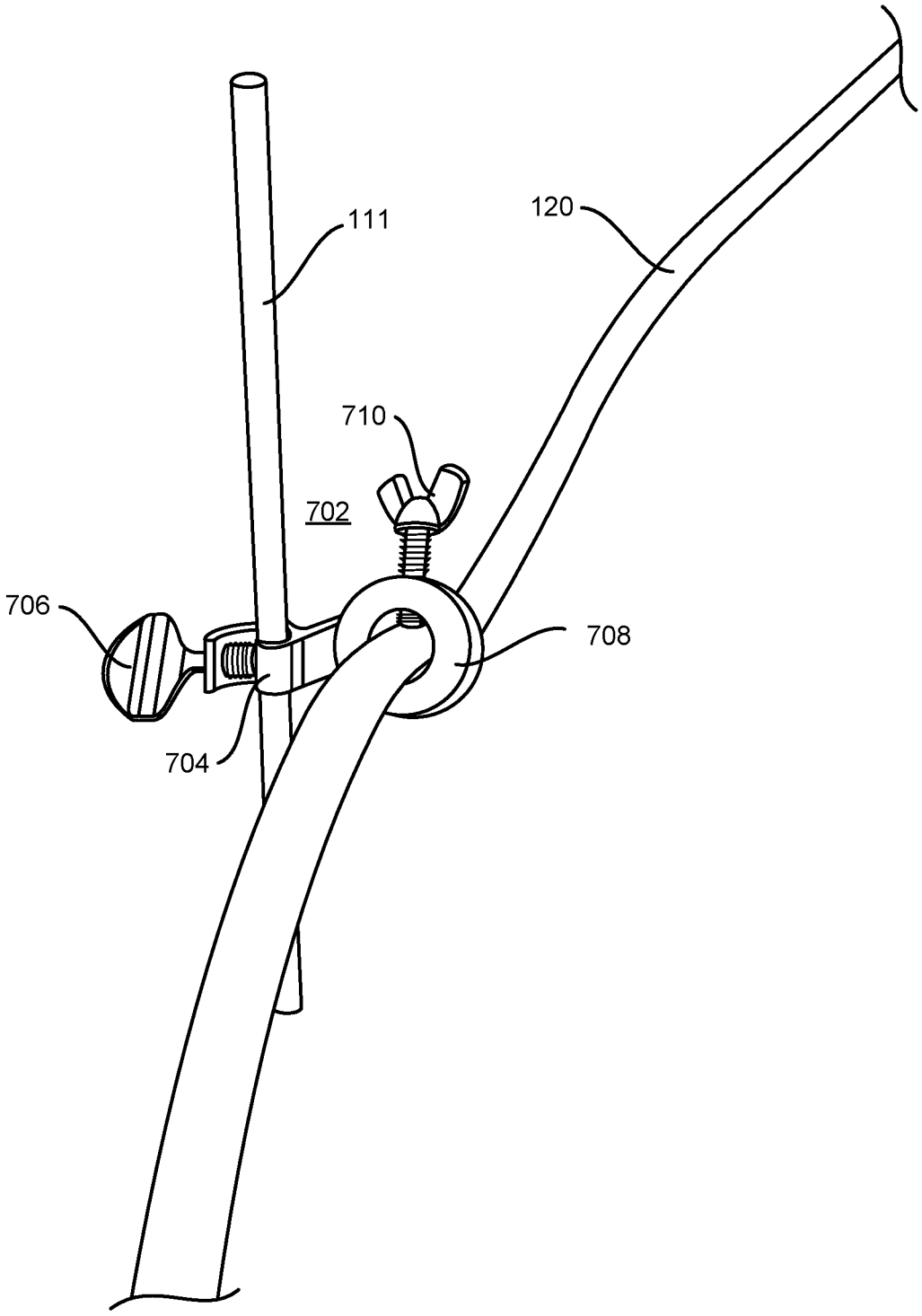
FIG. 8 illustrates another view of the adjustment members of FIG. 7.

FIG. 8 illustrates another view of the adjustment members 702.

Figure 9:
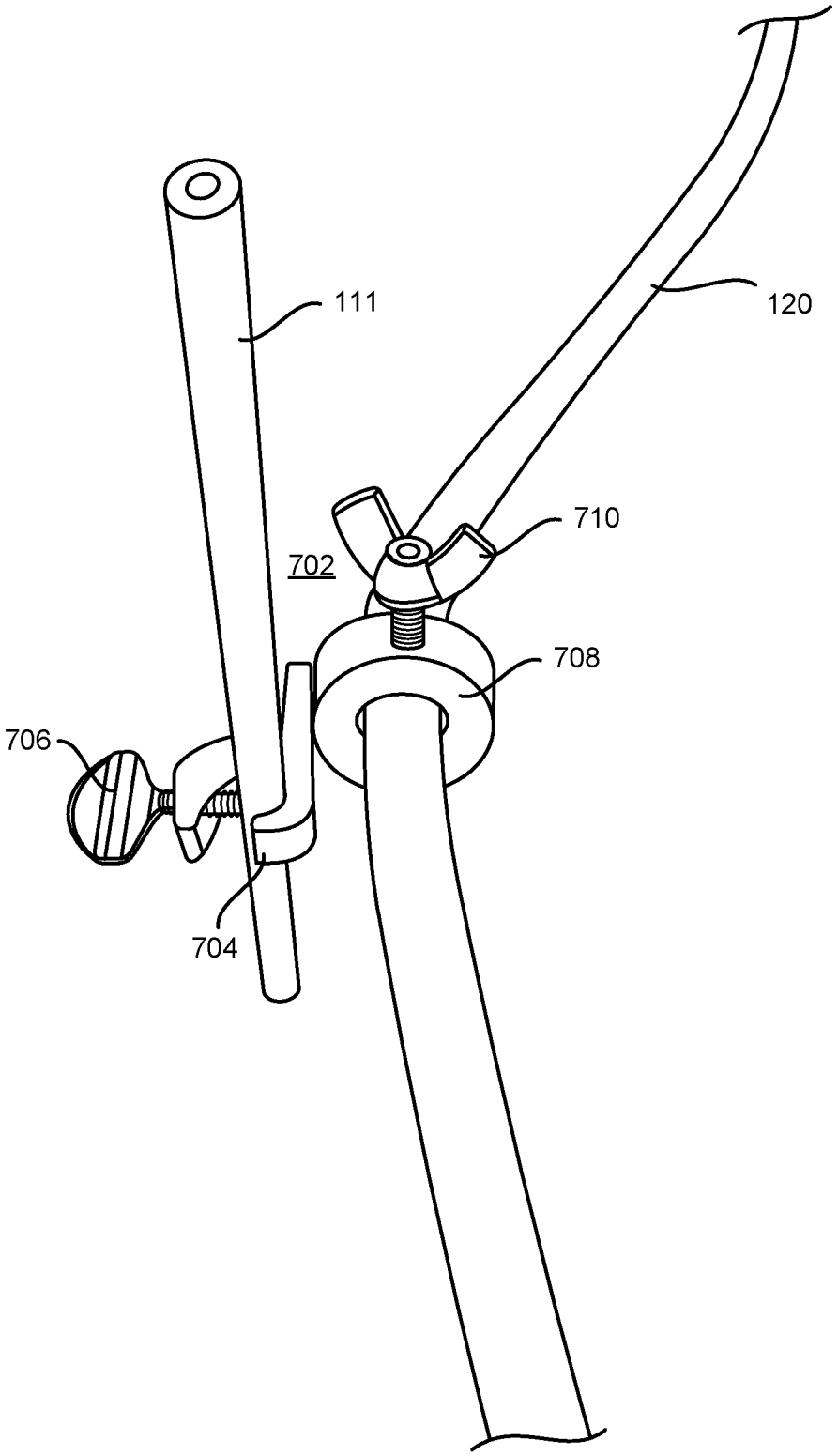
FIG. 9 illustrates yet another view of the adjustment members of FIG. 7.

FIG. 9 illustrates yet another view of the adjustment members 702.

Figure 10:
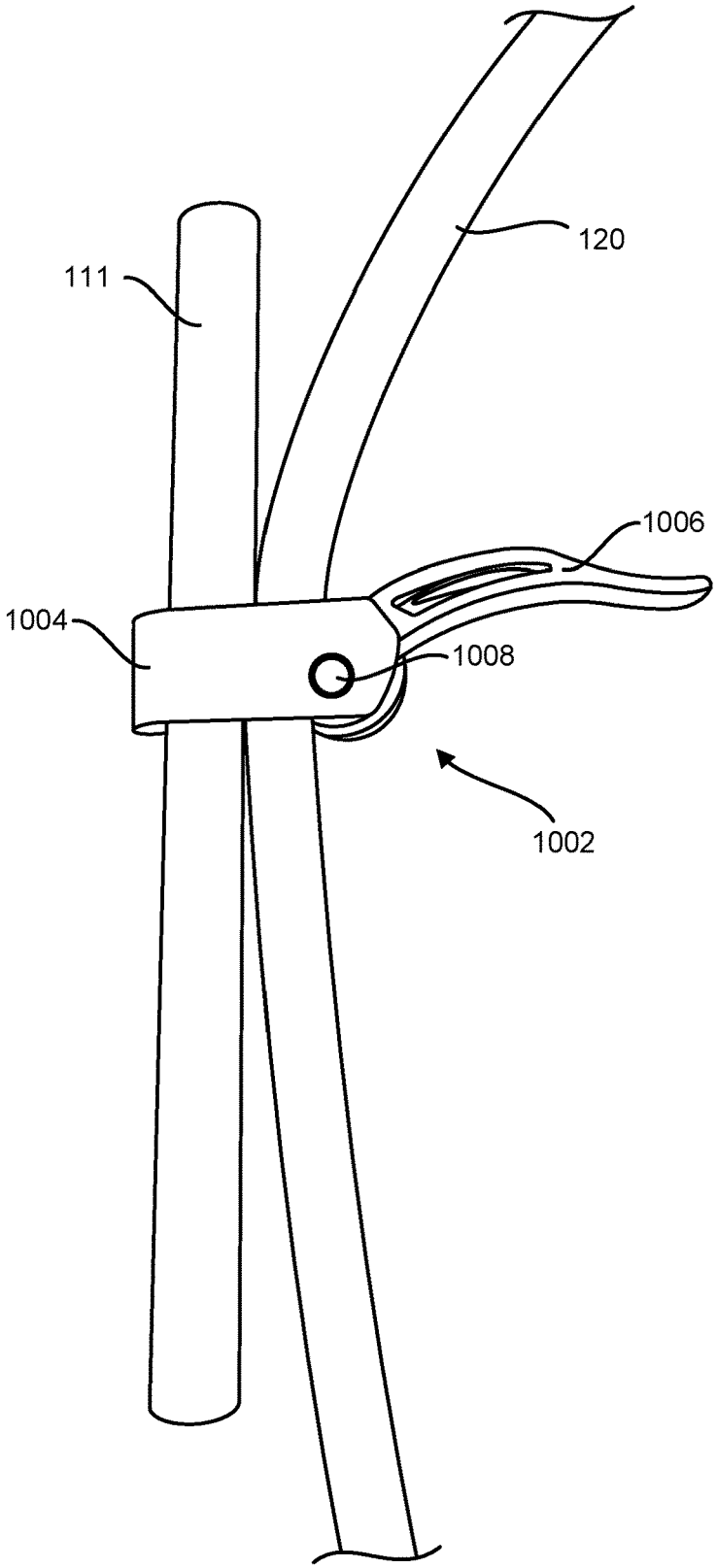
FIG. 10 illustrates alternate adjustment members in an open position that can be used instead of the adjustment members described by FIG. 4 and the adjustment members described by FIG. 7.

FIG. 10 illustrates alternate adjustment members 1002—that can be used instead of the adjustment members 152 described by FIG. 4 and the adjustment members 702 described by FIGS. 7-9. The adjustment members 1002 can include a bracket 1004, and a lever 1006 attached to the bracket 1004. The bracket 1004 can be attached to the lever 1006 via a screw 1008, around which the lever 1006 can rotate. Thus, the screw 1008 can act as an axis for the rotation of the lever 1006. The structure of at least one of the bracket 1004, the lever 1006, and the screw 1008 can limit the amount of rotation allowed for the lever 1006 around the screw 1008. The position of the lever 1006 as shown in FIG. 10 can be the open position.

Figure 11:
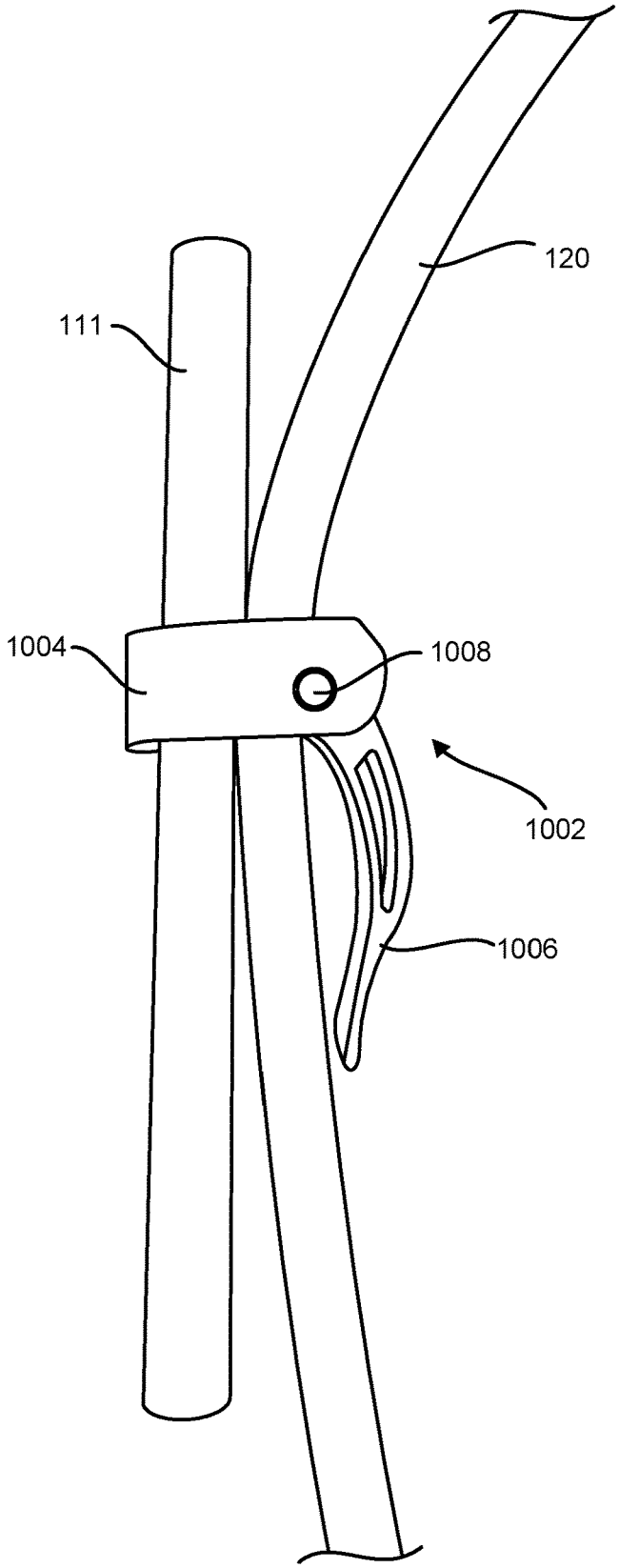
FIG. 11 illustrates the adjustment members of FIG. 10 in a closed position.

In the open position, the bracket 1004 can be moved along the length of any one or both of the pole 111 and the elastic member 120 to a desirable location along the length of each of the pole 111 and the elastic member 120. When a user has moved the bracket 1004 to a desirable location along the length of the pole 111 and/or the elastic member 120, the user can rotate the lever 1006 to the closed position, which is shown in FIG. 11. The movement of the bracket 1004 along the length of any of the pole 111 and the elastic member 120 is allowed in the open position of the lever 1006 due to movement of a structural part (not shown) of the lever 1006 that moves outward away from the pole 111 when the lever 1006 is moved from the closed position to the open position.

Different parts of the bracket 1004 can be made of a single/same material or of different materials. The one or more materials that can be used for the bracket 1004 can include metal, thermoplastic, thermoset, any other material, and/or any combination thereof. Different parts of the lever can be made of a single/same material or of different materials. The one or more materials that can be used for the lever 1006 can include metal, thermoplastic, thermoset, any other material, and/or any combination thereof. Different parts of the screw 1008 can be made of a single/same material or of different materials. The one or more materials that can be used for the screw 1008 can include metal, thermoplastic, thermoset, any other material, and/or any combination thereof.

In an alternate implementation, the bracket 1004 can be permanently attached at a preset location on the pole 111. In that implementation, the bracket 1004 can be attached to the pole via an attachment mechanism, such as welding. The welding can be a metal welding mechanism, a glass welding mechanism, a plastic welding mechanism, any combination thereof, and/or the like, depending on the materials of the bracket 1004 and the pole 111. Although welding is described as an attachment mechanism here, any other attachment mechanism may alternately be used, such as gluing, attaching via a structural lock, stitching, any other attachment mechanism, and/or any combination thereof.

FIG. 11 illustrates the adjustment members 1002—of FIG. 10—in a closed position. The closed position can be attained when the lever 1006 is rotated to this position, described above with respect to FIG. 10. In the closed position, the bracket 1004 is prevented from moving along the length of any of the pole 111 and the elastic member 120. This movement of the bracket 1004 along the length of any of the pole 111 and the elastic member 120 is prevented due to movement of a structural part (not shown) of the lever 1006 that pushes inward toward the pole 111 when the lever 1006 is moved from the open position to the closed position.

The implementations set forth in the foregoing description do not represent all implementations consistent with the subject matter described herein. Instead, they are merely some samples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein.

What is claimed is:

1. A fitness training apparatus comprising:

at least one pole configured to extend from at least one vicinity of at least one shoulder of a user to another at least one vicinity of a waist of the user, the at least one pole configured to be attached to at least one harness strap at the at least one vicinity of the at least one shoulder of the user;

at least one set of one or more adjustable members adjustably coupled to the at least one pole; and at least one elastic member configured to be adjustably coupled to the at least one set of one or more adjustable members.

2. The fitness training apparatus of claim 1, further comprising at least one handle attached to the at least one elastic member.

3. The fitness training apparatus of claim 2, wherein:

the at least one pole is two poles;

the at least one set of one or more adjustable members are two sets of one or more adjustable members;

the at least one elastic member is two elastic members; and the at least one handle is two handles.

4. The fitness training apparatus of claim 1, wherein the adjustable coupling between the at least one set of one or more adjustable members and the at least one pole enables a variation in location of the at least one set of one or more adjustable members along the at least one pole.

5. The fitness training apparatus of claim 1, wherein the adjustable coupling between the at least one elastic member and the at least one set of one or more adjustable members enables a variation in location of the at least one set of one or more adjustable members along the at least one elastic member enabling a variability of a length of the at least one elastic member.

6. The fitness training apparatus of claim 1, wherein:

the at least one harness strap is configured to extend along a body of the user; and the at least one harness strap is secured in place via a fastening mechanism configured to be located along the body of the user.

7. The fitness training apparatus of claim 1, wherein the at least one harness strap is embedded within a clothing garment.

8. The fitness training apparatus of claim 1, wherein the at least one pole is configured to be attached to a belt at the at least one vicinity of the waist of the user.

9. The fitness training apparatus of claim 8, wherein the belt is configured to be attached to at least one leg strap, the at least one leg strap configured to wrap around at least one respective leg of the user.

10. The fitness training apparatus of claim 1, wherein the at least one pole has a shape of a bow.

11. The fitness training apparatus of claim 1, wherein:

the at least one set of one or more adjustable members comprises at least one bracket and at least one lever; and the at least one elastic member comprises an elastic band.

12. The fitness training apparatus of claim 11, wherein the at least one bracket is capable of moving along a length of at least one of: the at least one pole and the at least one elastic member when the at least one lever is in an open position.

13. The fitness training apparatus of claim 11, the at least one bracket is prevented from moving along a length of at least one of: the at least one pole and the at least one elastic member when the at least one lever is a closed position.

14. A fitness training apparatus comprising:

at least one pole configured to extend from at least one vicinity of at least one shoulder of a user to another at least one vicinity of a waist of the user;

at least one set of one or more adjustable members adjustably coupled to the at least one pole, the at least one set of one or more adjustable members comprising one or more of: at least one first bracket, at least one first thumb screw, at least one second bracket, and at least one second thumb screw; and at least one elastic member configured to be adjustably coupled to the at least one set of one or more adjustable members.

15. The fitness training apparatus of claim 14, wherein:

the at least one first thumb screw is configured to pass through the at least one first bracket, and wherein:

a tightening of the at least one first thumb screw hinders a movement of the at least one first bracket along a length of the at least one pole; and a loosening of the at least one first thumb screw allows a movement of the at least one first bracket along the length of the at least one pole.

16. The fitness training apparatus of claim 14, wherein:

the at least one second thumb screw is configured to pass through the at least one second bracket, and wherein:

a tightening of the at least one second thumb screw hinders a movement of the at least one second bracket along a length of the at least one elastic member; and a loosening of the at least one second thumb screw allows a movement of the at least one second bracket along the length of the at least one elastic member.

17. A fitness training apparatus comprising:

at least one pole configured to extend from at least one vicinity of at least one shoulder of a user to another at least one vicinity of a waist of the user;

at least one set of one or more adjustable members adjustably coupled to the at least one pole, the at least one set of one or more adjustable members comprising one or more of: at least one connector, at least two washers, and at least one thumb screw; and at least one elastic member configured to be adjustably coupled to the at least one set of one or more adjustable members.

18. The fitness training apparatus of claim 17, wherein:

a tightening of the at least one thumb screw hinders a movement of the at least one connector along a length of the at least one pole; and a loosening of the at least one thumb screw allows a movement of the at least one connector along the length of the at least one pole.

19. The fitness training apparatus of claim 17, wherein:

a tightening of the at least one thumb screw hinders a movement of the at least one connector along a length of the at least one elastic member; and a loosening of the at least one thumb screw allows a movement of the at least one connector along the length of the at least one elastic member.

20. The fitness training apparatus of claim 17, wherein the at least one thumb screw is configured to pass through the at least two washers and be received by the at least one connector.

* * * * *